US006382623B1

(12) United States Patent
Gibson

(10) Patent No.: US 6,382,623 B1
(45) Date of Patent: May 7, 2002

(54) REPRODUCTION APPARATUS

(75) Inventor: Mark S. Gibson, Sodus Center, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/981,831

(22) Filed: Oct. 18, 2001

Related U.S. Application Data

(62) Division of application No. 09/537,484, filed on Mar. 30, 2000.

(51) Int. Cl.[7] ..... B65H 3/44
(52) U.S. Cl. ..... 271/157; 271/162; 399/393
(58) Field of Search ..... 271/157, 162, 271/164; 399/393

(56) References Cited

U.S. PATENT DOCUMENTS

| | | | | | |
|---|---|---|---|---|---|
| 5,157,448 | A | | 10/1992 | Lang | 355/309 |
| 5,240,242 | A | * | 8/1993 | Ando et al. | 271/116 |
| 5,884,123 | A | | 3/1999 | Stickney et al. | 399/107 |
| 5,918,875 | A | | 7/1999 | Masley et al. | 271/162 |
| 5,926,671 | A | | 7/1999 | Leibman | 399/110 |
| 6,188,886 | B1 | * | 2/2001 | Macaulay et al. | 379/142.01 |
| 6,332,609 | B1 | * | 12/2001 | Arakawa | 271/157 |

FOREIGN PATENT DOCUMENTS

| | | | | |
|---|---|---|---|---|
| JP | 3-26615 | * | 3/1991 | B65H/1/14 |
| JP | 3-98920 | * | 3/1991 | B65U/1/26 |
| JP | 5-32333 | * | 5/1993 | B65H/3/44 |
| JP | 5-254231 | * | 5/1993 | B41J/35/10 |

* cited by examiner

*Primary Examiner*—David H. Bollinger
*Assistant Examiner*—Kenneth W Bower
(74) *Attorney, Agent, or Firm*—Andrew D. Ryan

(57) ABSTRACT

A solenoid stop assembly that prevents actuation of a gear and feed shaft when a tray is not substantially inserted in an apparatus. The solenoid stop assembly includes a mechanism slidably positionable between a first position and a second position to mechanically prevent a member of a solenoid from releasing a protrusion of a gear extension. A tray is adjustably positionable and functionally interacts with the mechanism in a region of the apparatus and, upon contact, causes the mechanism to move and interrupt motion of the member. A resilient member, such as a spring, biases the mechanism to a position which prevents actuation of a gear and feed shaft when the paper tray is not substantially closed.

7 Claims, 5 Drawing Sheets

REPRODUCTION APPARATUS

This application is a divisional of application Ser. No. 09/537,484, filed Mar. 30, 2000.

FIELD OF THE INVENTION

This invention relates to a reproduction apparatus and more specifically to a stop device that limits movement of part of a solenoid and prevents release and operation of a gear when a tray is not substantially inserted in the apparatus.

BACKGROUND OF THE INVENTION

Electrophotographic marking is a well-known, commonly used method of copying or printing documents. Electrophotographic marking is performed by exposing a charged photoreceptor with a light image representation of a desired document. The photoreceptor is discharged in response to that light image, creating an electrostatic latent image of the desired document on the photoreceptor's surface. Toner particles are then deposited onto that latent image, forming a toner image, which is then transferred onto a substrate, such as a sheet of paper. The transferred toner image is then fused to the substrate, usually using heat and/or pressure, thereby creating a permanent record of the original representation. The surface of the photoreceptor is then cleaned of residual developing material and recharged in preparation for the production of other images. Other marking technologies, for example, electrostatographic marking and ionography are also well-known.

An electrophotographic marking machine generally includes a document handling system for moving substrates from an input tray through the machine. While such document handling systems are generally successful, problems and mechanical failures may occur. For example, when the input tray is not fully inserted into the machine the mechanical linkage between the input tray and the remainder of the document handling system may not be properly engaged. This can result in feed wheel stalling, sheared gear teeth, and feed shaft twisting. Therefore, a device that prevents operation of a portion of the document handling system when a tray is not fully inserted would be beneficial.

Reference is made to the following United States patents relating to reproduction machines and components.

U.S. Pat. No. 5,884,123 relates to a compact electrostatographic reproduction machine, including a platen for positioning a document sheet having an original image to be reproduced; and a plurality of separately framed, mutually aligning machine modules variously containing electrostatographic process elements and subassemblies.

U.S. Pat. No. 5,157,448 relates to a reproduction machine paper loading drawer interlock system which provides protection from jams by preventing drawer opening during sheet feeding.

U.S. Pat. No. 5,926,671 relates to an actuator for actuating a latch for releasably securing a movable member to a frame.

U.S. Pat. No. 5,918,875 relates to a media tray for storing a supply of media for use in a printing apparatus. The media tray includes a body having a tray for storing the media, a cover and a handle.

All documents cited herein, including the foregoing, are incorporated herein by reference, in their entireties.

SUMMARY OF THE INVENTION

The principles of the present invention advantageously provides a device to prevent operation of a portion of the document handling system when the input tray is not fully inserted. The device advantageously fits in a low profile position in a reproduction machine and interacts with a member, for example, a surface of a input tray to prevent full activation of a solenoid and release of a gear. The device is generally cost effective compared to other assemblies, for example, drawer interlock switch, wire harness, and related software.

In accordance with one aspect of the present invention, there is provided an mechanism for use in a reproduction, printing, or copying apparatus incorporating, for example, digital imaging or xerography. Such a mechanism may be used in, for example, the Xerox® brand Model 214 and other models (analog, digital, printers, copiers, and multi-use apparatus for fax/scan/copy/print, etc.) which do not have an interlock switch on an opening door, tray, or moveable member where the position of the member and operational relationships between the member and other components are important. The apparatus includes an assembly and a first member slidably positionable in a direction substantially perpendicular to two sides of the assembly. A second member is also associated with the assembly and has a hinged end portion and a free end portion and has an arcuate range of movement. In addition, a third member such as a tray is slidably positionable in the apparatus. A surface of the third member functionally interacts with a portion of the first member and causes movement of the first member with respect to the second member. The first member may limit motion of the second member. The second member and the third member may be located on opposite sides of the assembly. The first member may extend from opposite sides of the assembly. A portion of the first member may extend substantially perpendicularly from a side of the assembly for a distance and then extends substantially parallel to the side of the assembly to a distal end portion forming a space between the side and a portion of the first member. The distal end portion may form at least two surfaces spaced apart at a distal end. The second member may be part of a solenoid. The third member may be a paper or a media tray. The first member may include a first surface and a second surface slidably positionable under the free end portion of the second member. The first surface may be at least partially located under a path of movement of the free end portion to prevent the free end portion from occupying one or more postions and to prevent the free end portion from releasing a fourth member. The fourth member may be a gear. The second surface may be located under the path of movement of the free end portion and allow a greater range of movement of the free end portion than a first surface and allow release of a fourth member from contact with the free end portion. The arcuate range of movement of the free end portion may be less than 45 degrees, preferably between about 15 and about 40 degrees. A surface of the first member may cause a motion of the second member to cease and stop the second member from moving to a position which allows release of a gear. The apparatus may further include a spring for biasing the first member in a direction with respect to the assembly. The spring may cause at least a portion of the first member to be oriented under the free end portion of the member when a portion of the third member is out of a region in the machine. The apparatus may further include a solenoid and gear and the solenoid may cause the second member to move to a position which releases the gear from the first member and causes the gear to rotate provided a portion of the first member is not in a path of movement of a portion of the solenoid. In the process of moving the tray to one or more positions, a portion of the tray may transfer a force to a portion of the first member and causes movement of the first member which substantially prevents release of a gear. A portion of the first member may be slidably positionable in a path of movement of a portion of the second member when the third member is out of an operational position. The first surface and the second surface may each have a different height. The first and second members may be substantially rigid. The first member may include at least one molded part, preferably two parts, and may be insertable through at least a portion of the assembly. The first member may include a plurality of parts snap-fit together. The first member may further include an exterior surface for contact with the third member. The paper tray may cause the second mechanism to be moved to a position that interrupts a path of motion of the member.

In accordance with another aspect of the present invention, there is provided a solenoid stop in a reproduction machine including a first mechanism having at least one component and a second mechanism operatively associated with the first mechanism. The first mechanism may include between about six and about twenty four components, for example, gears, support walls, bearings, journals, axles, springs, subassemblies, and solenoid. Other embodiments of the first mechanism may include hundreds of parts, depending on the complexity and design. The second mechanism is positionable between a first position, at a furthest most location in the B direction, and a second position, at a furthest most location in the A direction. A member is hinged to a solenoid. The member includes a free end and is positionable between a position out of contact with a surface of a solenoid and a position in contact with the surface of the solenoid. The member may be drawn down to the fourth position when an electrical circuit is closed. At least one tray is adjustably positionable and adapted to functionally interact with the second mechanism. A spring is used for biasing the second mechanism away from the second position. The tray, in the process of movement to one or more positions, causes the second mechanism to move to the second position to allow adequate movement of the member to release a portion of a gear in contact with a portion of the member. The second mechanism may prevent the member from occupying the fourth position and substantially prevents release of the gear when the at least one tray is not occupying a region in the reproduction machine. The tray may cause movement of the second mechanism to a position which allows the member to occupy the fourth position.

In accordance with another aspect of the present invention, there is provided an electrostatographic reproduction machine including a platen for positioning a document sheet, a plurality of electrostatographic process elements, a first mechanism having at least one component for use in the reproduction machine, and a second mechanism operatively associated with the first mechanism. The second mechanism is positionable between a first position and a second position. At least one tray is adjustably positionable and adapted to functionally interact with the second mechanism. A member is positionable between a third position and a fourth position. The tray, in one or more positions causes the second mechanism to move to the second position; the member to move below a distal end of the second mechanism; and the member to release a portion of a gear.

Still other objects and advantages of the present invention and methods of construction of the same will become readily apparent to those skilled in the art from the following detailed description, wherein a number of the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

DETAILED DESCRIPTION OF THE INVENTION

While the principles of the present invention will be described in connection with an electrostatographic reproduction machine, it should be understood that the present invention is not limited to that embodiment or to that application. Therefore, it is should be understood that the principles of the present invention extend to all alternatives, modifications and equivalents as may be included within the spirit and scope of the appended claims.

The present invention relates to a solenoid stop assembly to prevent actuation of a gear and feed shaft when a tray is not fully inserted. The solenoid stop assembly includes a mechanism slidably positionable between a first position and a second position to mechanically prevent a member of a solenoid from closing and releasing a portion of a gear. A tray is adjustably positionable and functionally interacts with a mechanism in a region causing the mechanism to move and interrupt motion of the member. A resilient member, such as a spring, biases the mechanism when the paper tray is not fully in a closed position.

Figure 1:
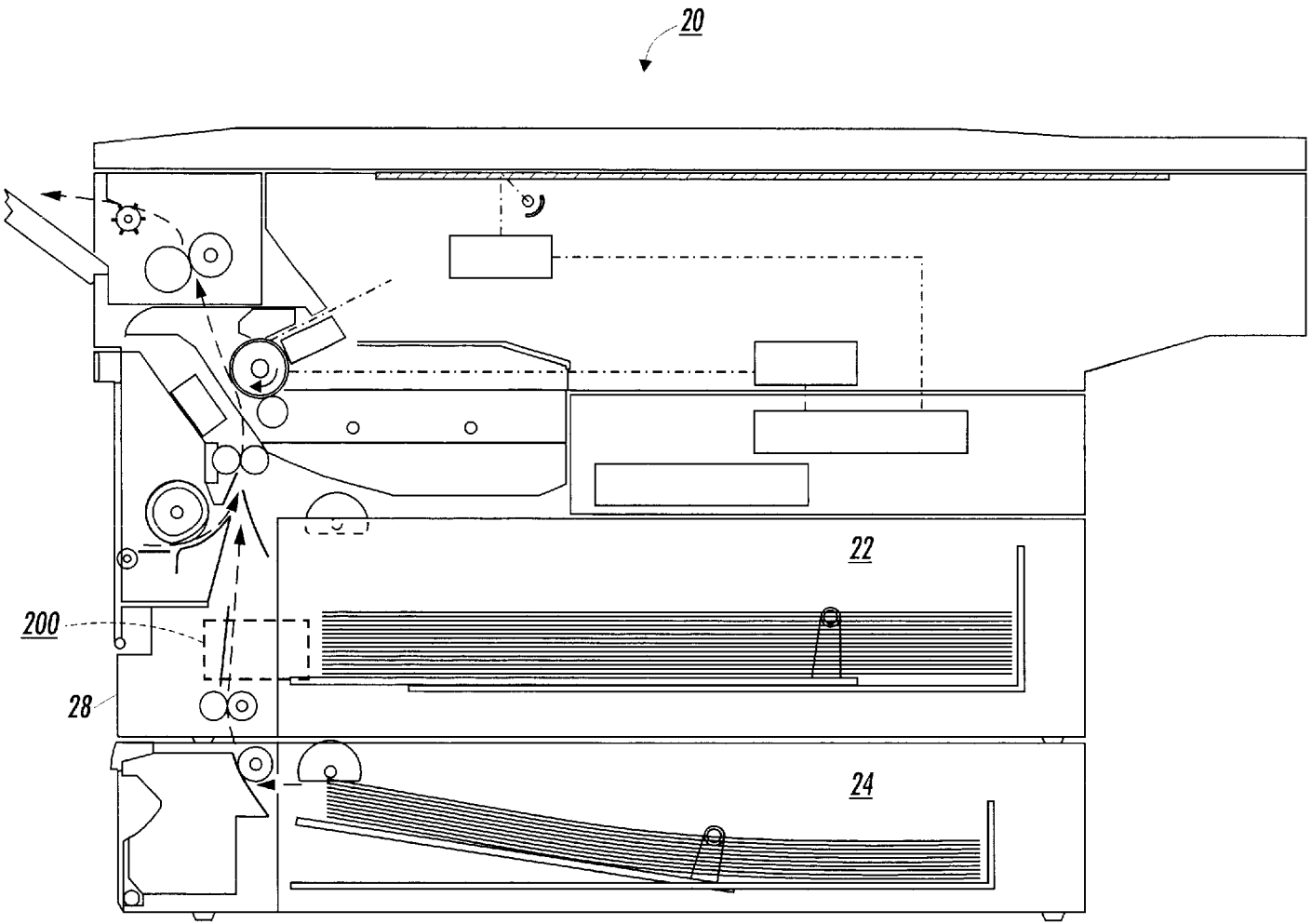
FIG. 1 is a front elevation view of an electrostatographic reproduction machine.

Referring to FIG. 1, a compact electrostatographic reproduction machine 20 incorporating a gear and solenoid stop assembly 200 in module 28 is shown. The gear and solenoid stop assembly 200 is preferably used in conjunction with a paper input tray 22. Preferably, the machine 20 also includes an auxiliary tray 24.

Figure 2:
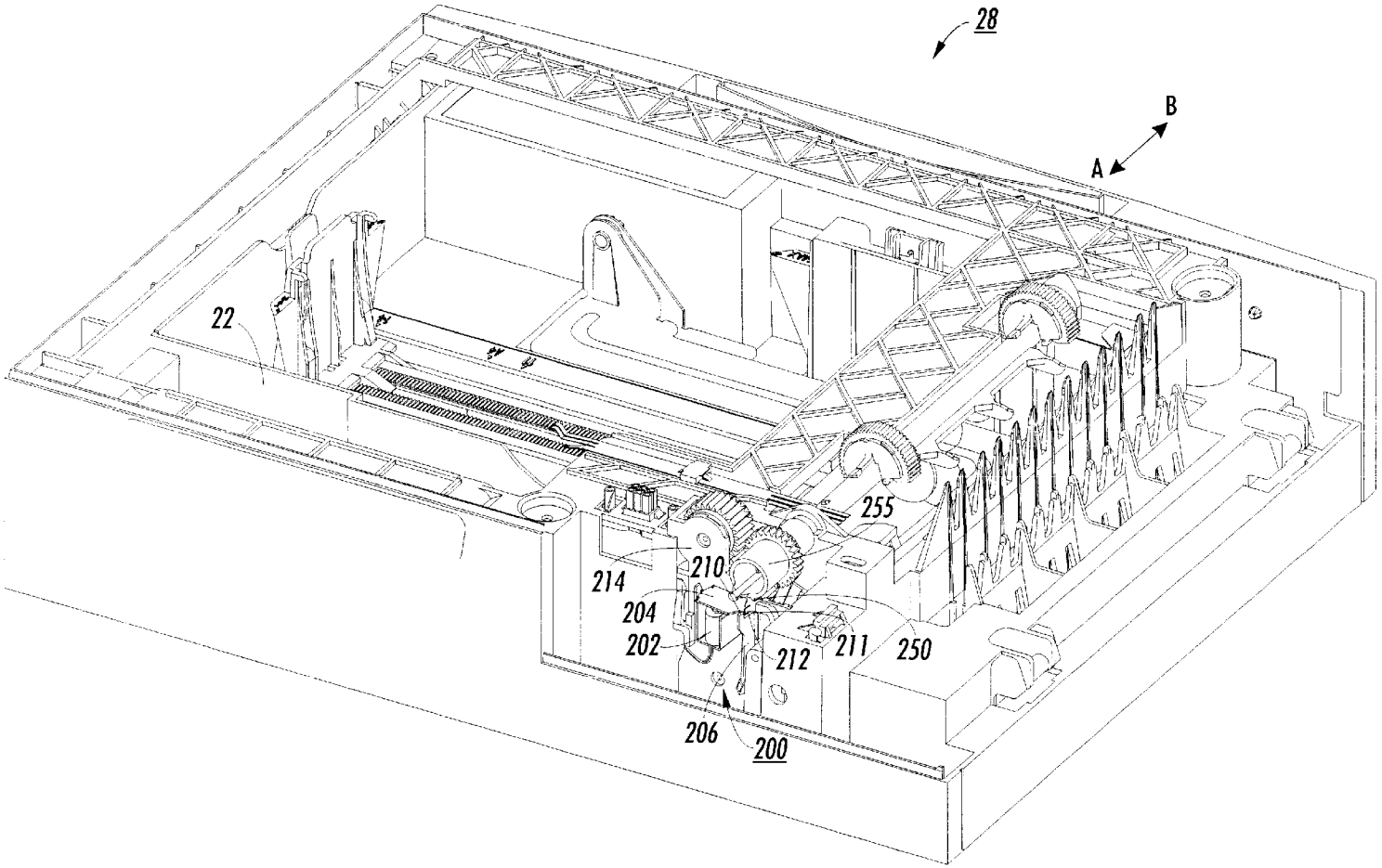
FIG. 2 is a perspective view of a module of the machine including a solenoid stop.

FIG. 2 illustrates the gear and solenoid stop assembly 200 in the module 28 in more detail.

Figure 3:
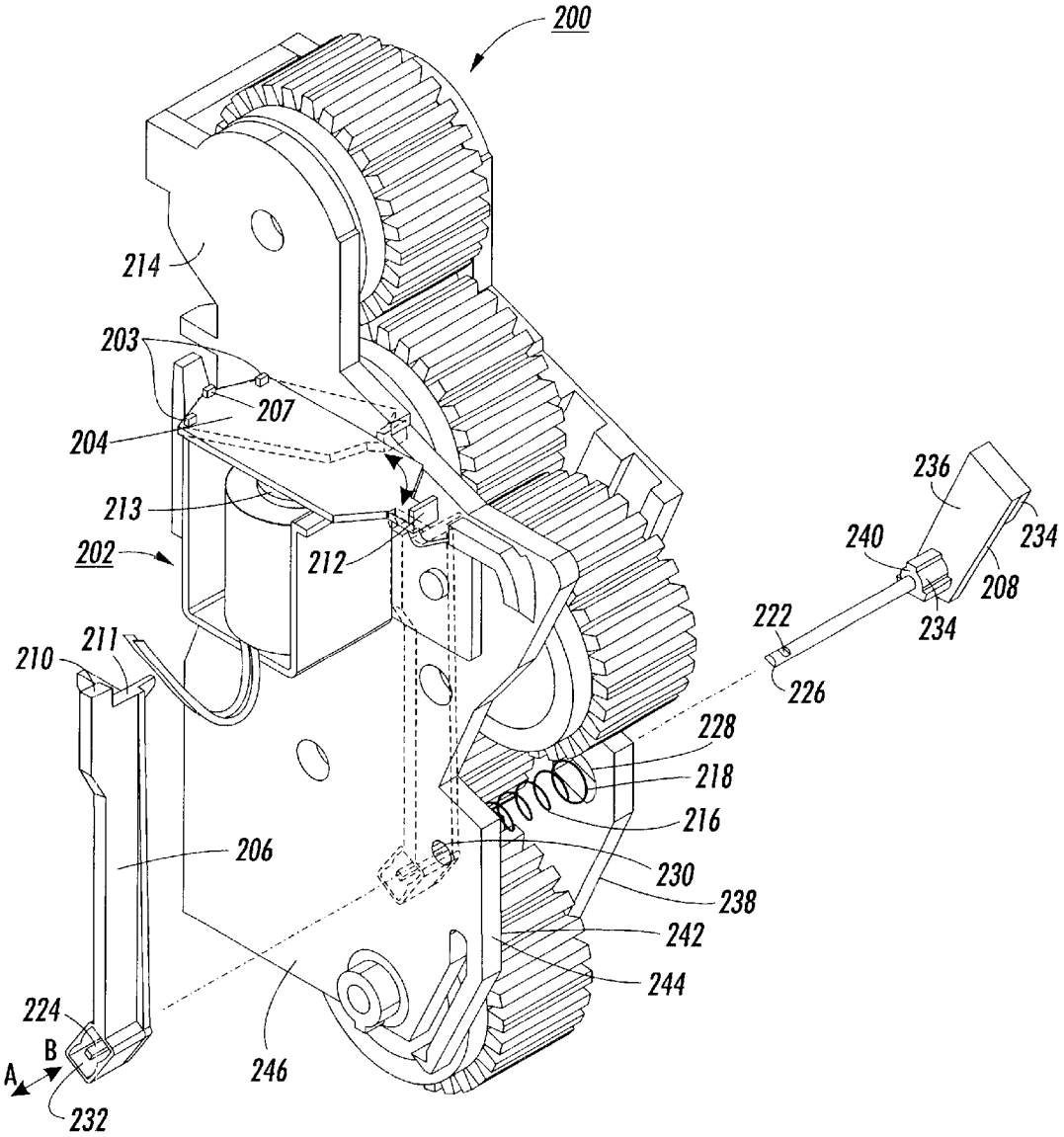
FIG. 3 is a perspective view of the solenoid stop of the machine of FIG. 1.

FIG. 3 illustrates the gear and solenoid stop assembly 200 including solenoid 202, solenoid pawl member 204, gear bracket assembly 214, solenoid stop member 206, plunger member 208, and a resilient member 216, for example, a spring.

Solenoid pawl member 204 is hinged to the solenoid 202 at positions 203. Solenoid pawl member 204 is arcuately positionable between a first position, in contact with the surface 213 of the solenoid 202, and a second position out of a contact with the surface 213. The solenoid pawl member 204 is biased to a position out of contact with surface 213 due to a spring (not shown) connected at one end at position 207 and at the other end to part of the solenoid.

Plunger member 208 passes through the gear bracket assembly 214 and is connected to the solenoid stop member 206. End 226 of the plunger member 208 is slidably inserted through hole 228, through resilient member 216, through hole 230, and into a lumen 232 in the solenoid stop member 206. Surface 236 of plunger member 208 is oriented toward surface 238 of gear bracket assembly 214.

A collar 234 on plunger member 208, formed in a noncircular or irregular shape, for example, a D shape, slidably fits into hole 228 of gear bracket assembly 214. Hole 228 is formed in the same general shape as the perimeter of the collar 234, and slidably receives the collar 234 to prevent the connected solenoid stop member 206 and plunger member 208 from rotating about an axis in holes 228, 230. Alternate non-circular shapes of the collar 234 and the hole 228 are envisioned to prevent rotation of connected members 206, 208. One end 218 of the resilient member 216 is situated adjacent a face 240 of the collar 234 and the other end 220 of the resilient member 216 sits against an inside surface 242 of a wall 244.

Preferably, solenoid stop member 206 and plunger member 208 are snapped together by a mechanical locking system, such as a notch 222 and tab 224. Alternative connection between the solenoid stop member 206 and the plunger member 208 may be made by chemical adhesion, thermal adhesion, or pressure fit. Preferably, solenoid stop member 206 and plunger member 208 are made of a molded plastic although other materials such as metal may also be used.

In use, solenoid stop member 206 and plunger member 208 are biased in a direction B towards the input tray 22 due to the built-in resilient force of end 218 of the resilient member 216 against the face 240 of the collar 234. For stability, portions of the solenoid stop member 206 may slide against the housing of the solenoid 202 up to the surface 246 of the gear bracket assembly.

Figure 4:
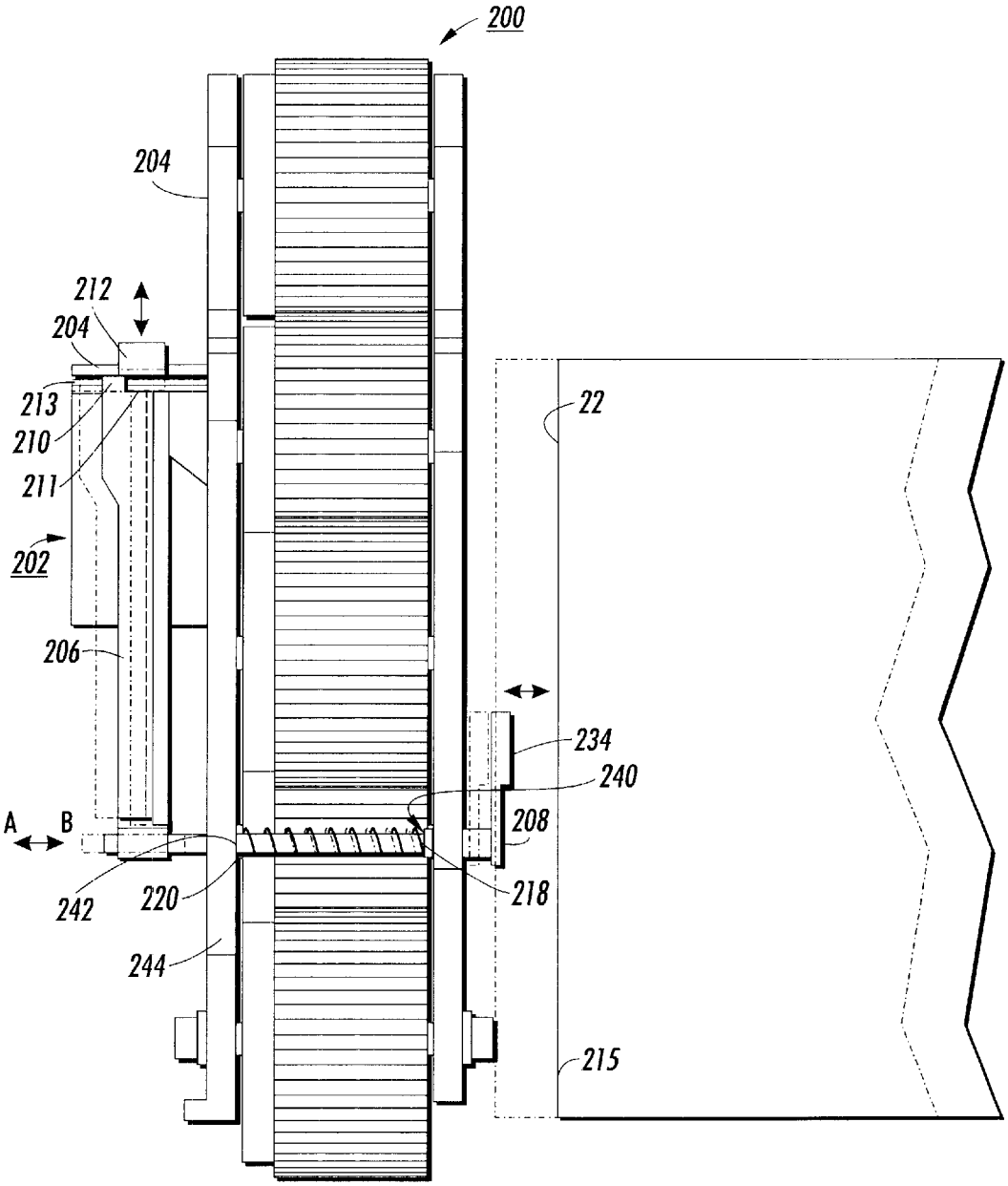
FIG. 4 is a front elevation view of the solenoid stop and paper tray of the machine of FIG. 1.

In FIG. 4, solenoid stop member 206 and plunger member 208 are shown slidably positionable with respect to solenoid pawl member 204. Input tray 22 slides and interacts with surface 234 of the plunger member 208 on one side of the gear bracket assembly 214. Solenoid stop member 206 and plunger member 208 may slide through the assembly and move to any position within the designed range of movement. Although the solenoid stop member 206 and plunger member 208 may be incorporated into larger machines and move a number of feet or yards, preferably, the plunger member moves a distance up to about 1 inch; and especially preferably, for example, a distance of about 0.125 inches to about 0.25 inches, when a force from the surface 215 of the input tray 22 is applied to the surface 234. As plunger member 208 slidably moves in direction A, the solenoid stop member 206, on the opposite side of the gear bracket assembly 214, also moves in direction A. The speed of movement of plunger member 208 substantially corresponds to the speed of movement of surface 215. Depending, for example, the type of materials used in the parts, and the machining, fit, flex and tolerances in the connection of the parts, ends 210, 211 at the distal end of solenoid stop member 206 may move, for example, about 25% to about 100% of the distance of movement of the plunger member 208.

Accordingly, ends 210 and 211 of the solenoid stop member 206 are each slidably alignable under the end portion 212 of the solenoid pawl member 204. As plunger member 208 is pushed by a surface 215 of the input tray 22, resilient member 216 is compressed while the solenoid stop member 206 is moved in direction A. When input tray 22 is in a fully inserted positioned in the machine 20, end 211 is substantially situated below end portion 212 of the solenoid pawl member 204 allowing a generally fuller arcuate range of motion of end portion 212. Alternatively, as the input tray 22 is moved in direction B, the plunger member 208 also moves in the direction B due to the bias of the resilient member 216 against the collar 234. For example, as input tray 22 is retracted a distance of, for example, about 1/64 inch to about 1 inch, preferably about 1/32 inch to about 3/16 inch, end 210 becomes positioned under the path of motion of end portion 212, and prevents the end portion 212 from being drawn down toward surface 213, and prevents end portion 212 from releasing protrusion 250 of gear extension 255.

Figure 5:
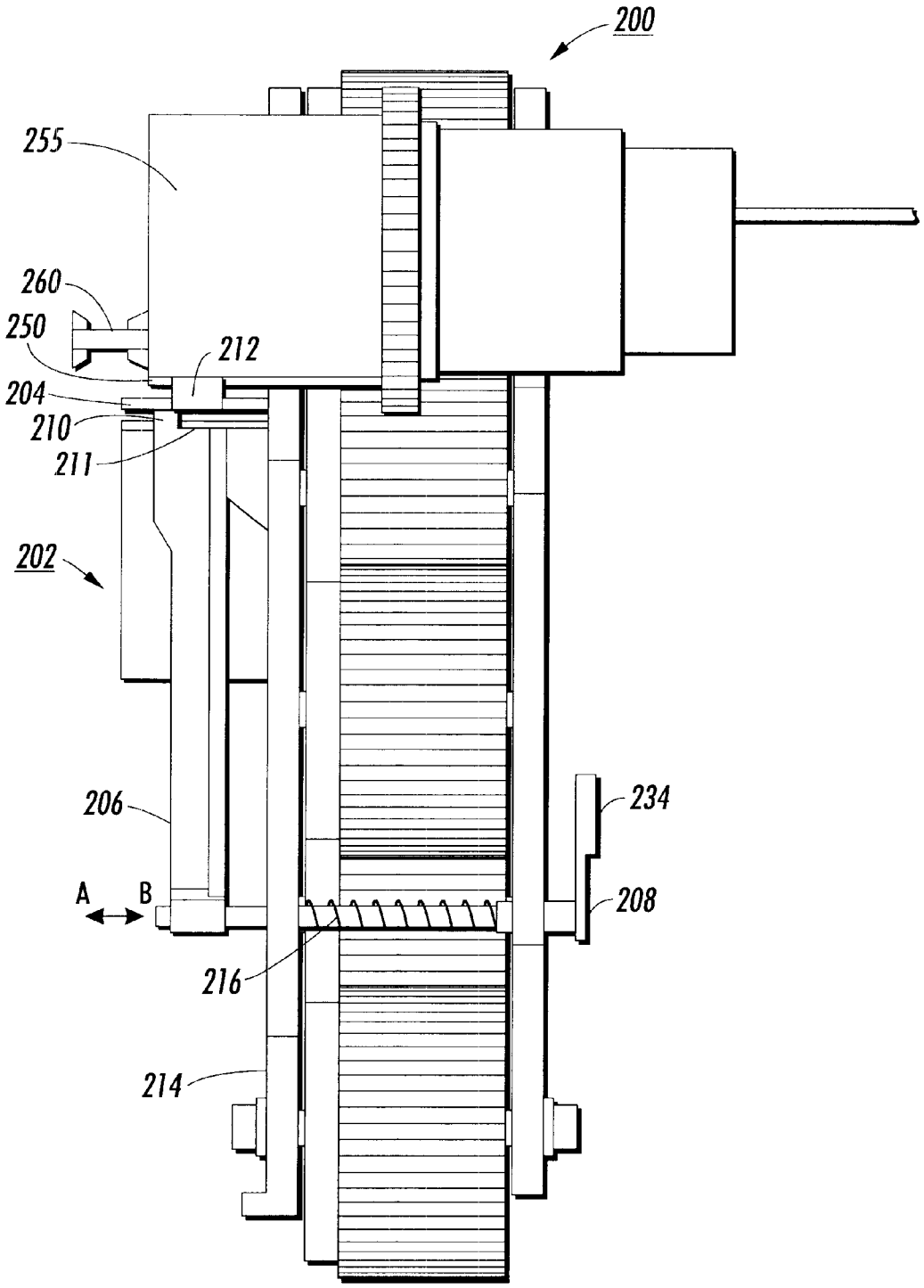
FIG. 5 is a front elevation view of the solenoid stop and gear of the machine of FIG. 1.

FIG. 5 further illustrates interaction of the gear and solenoid stop assembly 200 with respect to gear extension 255. End 210 is situated higher than end 211. The difference in height between end 210 and end 211 ranges from about 1/32 inch to about 3/4 inch, preferably about 0.1 inch.

In use, as solenoid stop member 206 slides in the direction A, the higher end 210 moves out from under the bottom of end portion 212 and the lower end 211 allows the end portion 212 to move away and off protrusion 250 and allows end portion 212 to release from the protrusion 250 of gear extension 255. Subsequently, the gear extension 255 and associated sector gear may then rotate the feed shaft which feeds paper in the printing machine 20. One end of a spring (not shown) is attached to an end portion 260 extending from the end of gear extension 255 and the other end of the spring (not shown) is attached to an adjacent surface of the module to provide tension in the spring.

Solenoid stop member 206 is biased in direction B, towards the input tray 22. As input tray 22 is moved out of place, end 210 of solenoid stop member 206 generally becomes positioned under the pawl member 204 to interrupt the arcuate path of motion of pawl member 204 if it is drawn down to the surface 213 of solenoid 202. The step of withdrawing the input tray 22 generally causes ends 210, 211 to move in the direction B under the solenoid pawl member provided end portion 212 is not below end 210, for example, on end 211. When end 211 is substantially positioned under the path of motion of end portion 212, end portion 212 has a greater range of motion and may be drawn down on the solenoid. The extra range of motion allows the protrusion 250 of a spring loaded gear extension 255 to be released from the end portion 212 and the connecting shaft can rotate to feed paper.

In summary, the gear and solenoid stop assembly 200 including ends 210, 211 advantageously limit operation of the document handling system depending on the position of input tray 22. End 210 mechanically prevents end portion 212 from a full range of movement and causes the sector gear to remain inoperative and stationery when the input tray 22 is not fully inserted in the machine 20. The gear and solenoid stop assembly 200 advantageously prevents inadvertent operation of components and reduces operational problems, for example, prevention of feed wheels from catching on the snubbers and stalling; stalling of sector gear; shearing of gear teeth; and twisting of feed shafts.

In operation, a first member extends from two sides of a mechanism and is slidably positionable with respect to the mechanism. The mechanism includes a second member having one free end and a range of movement. A third member, for example, a tray is slidably positionable in the machine and with respect to the first member. A surface of the third member interacts with a surface of the first member and moves the first member with respect to the second member to control movement of a free end of the second member with respect to a gear, to control activation of the gear. Activation of the gear depends on the position of the tray and the position of the first member with respect to the second member.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A solenoid stop comprising:

a first mechanism having at least one component, a second mechanism operatively associated with the first mechanism, the second mechanism positionable between a first position and a second position;

a member operationally connected to a solenoid and having a free end, the member positionable between a third position and a fourth position;

at least one tray adjustably positionable and adapted to functionally interact with the second mechanism; and a spring for biasing the second mechanism away from the second position;

wherein the at least one tray, in the process of movement to one or more positions, causes the second mechanism to move to the second position and allows adequate movement of the member to release a gear in contact with the member.

2. The solenoid stop of claim 1 wherein the second mechanism prevents the member from occupying the fourth position and prevents release of the gear when the at least one tray is not occupying a region in the reproduction machine.

3. The solenoid stop of claim 1 wherein the at least one tray is adapted to cause movement of the second mechanism to a position which allows the member to occupy the fourth position.

4. The solenoid stop of claim 1 wherein the solenoid stop further comprises components of a reproduction apparatus.

5. The solenoid stop of claim 1 wherein the first mechanism includes between about six and about twenty four components.

6. An electrostatographic apparatus comprising:

a platen for positioning a document sheet;

electrostatographic process elements;

a first mechanism having at least one component;

a second mechanism operatively associated with the first mechanism, the second mechanism positionable between a first position and a second position;

a member positionable between a third position and a fourth position; and at least one tray adjustably positionable and adapted to functionally interact with the second mechanism;

wherein the at least one tray, in at least one position, is adapted to cause: (a) the second mechanism to move to the second position; (b) the member to move below a distal end of the second mechanism; and (c) the member to release a portion of a gear.

7. An apparatus comprising:

an assembly of gears, the assembly having a first side and a second side;

a first member slidably positionable with respect to the assembly of gears, the first member slidable a distance up to about 1 inch, the first member extending from the first side and the second side;

a second member having a first end and a second end, the second end having a greater range of movement than the first end, the second member positioned on one of the first side and the second side; and a third member comprising a tray, the third member slidably positionable with respect to the first member;

wherein a surface of the third member functionally interacts with the first member when the third member is within a distance of up to about 1 inch of its fully inserted position in an apparatus and causes the first member to move with respect to the second member.

* * * * *